US006508956B1

(12) United States Patent
Baker et al.

(10) Patent No.: US 6,508,956 B1
(45) Date of Patent: Jan. 21, 2003

(54) PAPER COATING TEST METHOD AND COMPOSITION

(75) Inventors: Ronald Willard Baker, Versailles, KY (US); David Clay Blaine, Lexington, KY (US); Philip Jerome Heink, Lexington, KY (US); John William Kietzman, Lexington, KY (US); David Starling MacMillan, Winchester, KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/912,984

(22) Filed: Jul. 25, 2001

(51) Int. Cl.[7] ..... C09K 11/02

(52) U.S. Cl. ..... 252/301.16; 524/800; 524/366; 524/386; 524/389; 252/301.16; 556/444; 556/445; 568/852; 427/331

(58) Field of Search ..... 524/588, 800, 524/366, 386, 389; 252/301.16; 556/444, 445; 568/852; 427/331

(56) References Cited

U.S. PATENT DOCUMENTS

| | | | | |
|---|---|---|---|---|
| 3,675,015 | A | | 7/1972 | Geib |
| 3,956,630 | A | | 5/1976 | Mellows |
| 4,250,382 | A | | 2/1981 | Libby |
| 4,458,360 | A | | 7/1984 | Venalainen et al. |
| 4,981,726 | A | | 1/1991 | Rantanen et al. |
| 5,124,149 | A | * | 6/1992 | Shapiro et al. |
| 5,162,131 | A | | 11/1992 | Rantanen et al. |
| 5,281,467 | A | | 1/1994 | Shimada et al. |
| 5,310,604 | A | | 5/1994 | Melancon et al. |
| 5,490,980 | A | * | 2/1996 | Richardson et al. |
| 5,912,139 | A | * | 6/1999 | Iwata et al. |

FOREIGN PATENT DOCUMENTS

| | | | |
|---|---|---|---|
| EP | 405341 | * | 1/1991 |
| GB | 2 099 994 A | | 12/1982 |

* cited by examiner

*Primary Examiner*—Robert Dawson
*Assistant Examiner*—Kuo-Liang Peng
(74) *Attorney, Agent, or Firm*—David E. LaRose

(57) ABSTRACT

The invention provides a test fluid for detecting coating flaws in a coated web and a method for testing a web coating system. The test fluid includes, water, a polyol, a surfactant, a radiant energy activated tracer compound and an organic solvent selected from the group consisting of an alkylene glycol and a dialkylene glycol. The test fluid is used to identify deficiencies in the web coating system so that adjustments to the web coating system may be made before assembling the coating system in an ink jet printer.

9 Claims, 2 Drawing Sheets

PAPER COATING TEST METHOD AND COMPOSITION

FIELD OF THE INVENTION

The invention relates to procedures and compositions for determining the performance of paper coating apparatus for ink jet printers.

BACKGROUND OF THE INVENTION

Ink jet printing methods use printheads having orifices which eject ink droplets onto a print medium. For higher quality, higher resolution printing applications, the orifices of the printheads have been increased in number and their diameter significantly reduced in size. Accordingly, for full color printed images, inks are formulated to include dyes and/or pigments and various carriers and/or solvents which are resistant to drying or otherwise clogging the nozzle holes of the printhead. Such ink formulations, however often adversely affect the properties of the ink deposited on the print medium resulting in longer drying times and/or color mixing or bleeding of the images resulting in poorer quality images.

Print media used with ink jet printers include a wide variety of materials with the most widely used being cellulosic print media. Cellulosic webs used as print media are made by conventional paper making techniques wherein a fibrous pulp is deposited on a wire screen and dried to form a web. Accordingly, the webs contain minute pores or voids between the cellulosic fibers for absorption of liquids therein. The porosity of the webs may be changed by use of specialty coatings such as clays and the like which may change the hydrophilic properties of the webs so that the webs absorb or repel aqueous and/or organic fluids which may be used as carrier fluids in ink formulations.

It is desirable for only the carrier fluid of the ink formulation to penetrate into the web thereby depositing colorant on the outer surface of the web. Balancing the properties of the ink formulations so that the formulations are adaptable for use with a wide variety of print media is extremely difficult. It is even more difficult to provide ink formulations which may be used on uncoated or plain paper webs. In an effort to improve the print quality, the webs or print media are preferably coated with materials which improve the drying time and penetration of the ink. In one system, the webs are preferably coated immediately prior to printing. However, if the coating is not uniformly applied to the print media during the coating process, the image quality may suffer. Accordingly, a need exists for methods and compositions which can be used to assure uniform coating of the webs prior to printing.

SUMMARY OF THE INVENTION

With regard to the above and other objects and advantages thereof, the invention provides a test fluid for detecting coating flaws in a coated web and a method for testing a web coating system. The test fluid includes, water, a polyol, a surfactant, a radiant energy activated tracer compound and an organic solvent selected from the group consisting of an alkylene glycol and a dialkylene glycol.

In another aspect the invention provides a method for testing a web coating system used for applying a coating composition to a web prior to printing. The method includes the steps of inserting a test fluid in a web coating. The test fluid includes water, a polyol, a surfactant, a radiant energy activated tracer compound and an organic solvent selected from the group consisting of an alkylene glycol and a dialkylene glycol. The test fluid is then applied to a web to provide a test fluid coating on the web and the web is exposed to a radiant energy source. Upon identification of deficiencies in the coating system, the coating system is adjusted to provide a substantially uniform coating composition on a web prior to printing.

As used herein, the term "bleeding" refers to the unintended mixing of colors or wicking of ink colorant into the web rather than remaining on the surface of the web. Webs which are highly absorbent of the colorant tend to produce low resolution images because each ink dot tends to spread due to the affinity of the web fibers for the colorants in the ink. If the ink colorant penetrates too far into the web, too much light may be scattered by the interstices of the upper portion of the web resulting in a lower contrast image. Accordingly, it is desirable that only the ink carrier be absorbed into the web while the colorant remains substantially on the surface of the web.

An important advantage of the invention is the use of a substantially colorless test fluid to readily identify deficiencies in the web coating system without printing multiple visible alignment indicia or visible test patterns on a coated web. Once such deficiencies are identified, adjustments may be made to the web coating system before assembling the coating system in an ink jet printer. The test fluid is also selected to be compatible with the coating composition used during a printing operation while at the same time being substantially colorless, relatively non-corrosive, and stable so that long term storage of the test fluid in the coating system does not harm the coating system. Other important advantages and benefits of the test fluid and method are included in the following detailed description thereof.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENTS

Figure 1:
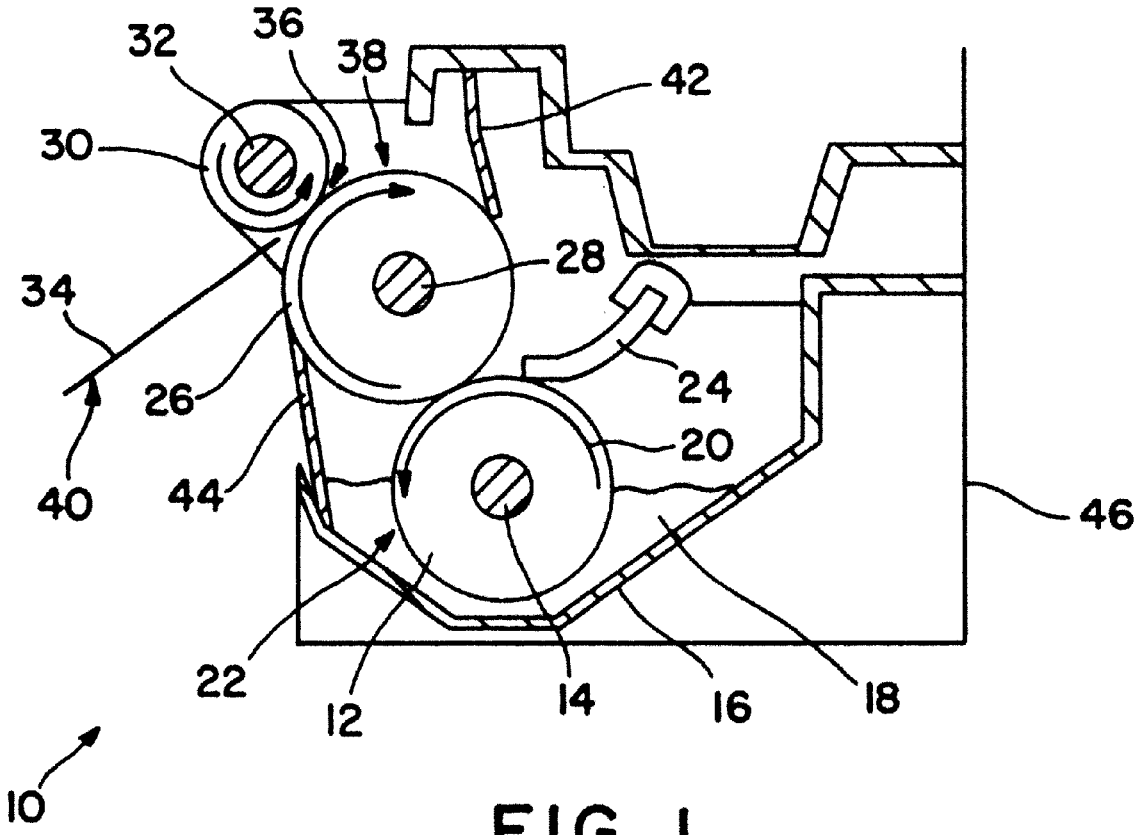
FIG. 1 is a partial cross-sectional view of a coating system for applying a coating to a web.

In an ink jet printer having improved print resolution, a coating composition is applied to a web immediately prior to printing the web with ink jet inks to provide enhanced drying of ink formulations in order to reduce or eliminate bleeding and/or ink smearing. The coating composition for the web, preferably a plain paper web, is adapted to promote ink drying and waterfastness. The web coating formulation is preferably an aqueous-based solution containing a fluid component which promotes increased penetration of the ink carrier into the web without promoting significant penetration of the colorant into the web.

The coating composition preferably includes a polyhydric alcohol selected from the group consisting of glycol-based solvents having a surface tension ranging from about 25 to below about 45 dynes/cm. The polyhydric alcohol is effective to promote ink drying. Preferred glycol-based solvents include but are not limited to 1,2-propanediol, dipropylene glycol, tripropylene glycol, and mixtures of two or more of the foregoing provided the glycol-based solvents have a surface tension ranging from about 25 to below about 45 dynes/cm. Glycol-based solvents, such as 1,2-propanediol and dipropylene glycol are widely used in soaps and cosmetics and as such are relatively safer than ethylene glycol-based solvents.

The surface tensions of various glycol-based solvents are contained in the following Table 1:

TABLE 1

| Glycol Material | Surface tension in dynes/cm |
|---|---|
| Tripropylene glycol | 34 |
| Dipropylene glycol | 37 |
| Tetraethylene glycol | 45 |
| Triethylene glycol | 47 |
| 1,3-propanediol | 47 |
| Diethylene glycol | 48 |
| Ethylene glycol | 48 |
| Polyethylene glycol 400 | 48 |
| Glycerol | 63 |
| 1,2-propanediol (propylene glycol) | 40 |

As seen in the foregoing Table 1, ethylene glycol-based solvents generally have surface tensions of above about 45 dynes/cm, whereas the glycol-based solvents have surface tensions ranging from a low of about 30 to below about 45 dynes/cm.

The amount of glycol-based solvent in the coating formulation preferably ranges from about 25 to about 96 percent by weight of the formulation, preferably from about 25 to about 75 percent by weight and most preferably from about 40 to about 60 percent by weight of the formulation. Particularly preferred glycol-based solvents may be selected from 100 percent by weight 1,2-propanediol and a mixture containing from about 75 to about 100 percent by weight 1,2-propanediol and from about 0 to about 25 percent by weight dipropylene glycol.

Another component of the coating formulation is selected from a polyvalent metal salt and an organic acid. It is preferred that the polyvalent metal salt be substantially soluble in water. The salt preferably contains a polyvalent metal cation and an inorganic or organic anion component. The polyvalent metal cation may be selected from $Ca^{2+}$, $Cu^{2+}$, $Ni^{2+}$, $Mg^{2+}$, $Zn^{2+}$, $Ba^{2+}$, $Al^{3+}$, $Fe^{3+}$ and $Cr^{3+}$. Of the foregoing, calcium and magnesium cations are preferred. The anion component of the polyvalent metal salt may be selected from a nitrate group, a chlorate group, a carboxylate group and a halogen ion such as $Cl^-$, $I^-$ and $Br^-$. Of the foregoing anions, the chloride ion and acetate group are preferred and the chloride ion is most preferred. A particularly preferred polyvalent metal salt is calcium chloride dihydrate.

The organic acid is preferably a hydroxy acid selected from the group consisting of lactic acid, glycolic acid, citric acid and malic acid. A particularly preferred organic acid for use in the formulation is citric acid. The amount of polyvalent metal salt or organic acid in the coating formulation preferably ranges from about 0.25 to about 20 percent by weight of the formulation.

The coating formulation also preferably contains a surfactant. The surfactant is preferably a non-hydrolyzable copolymer based on polydimethylsiloxane. The general structure of the surfactant is as follows:

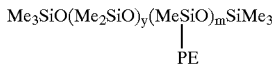

wherein: PE=—$CH_2CH_2CH_2O(EO)_n(PO)_oZ$,

Me=a methyl group,

EO=an ethyleneoxy group,

PO=1,2-propyleneoxy group,

Z=H or a methyl group, y=an integer ranging from about 1 to about 10, m=an integer ranging from about 1 to about 10, n=an integer ranging from about 0 to about 5, and o=an integer ranging from about 0 to about 5.

The surfactant preferably has a number average molecular weight ranging from about 800 to about 5000 $MW_N$, preferably from about 1000 to about 4000 $MW_N$. Representative structures include the following:

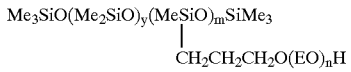

which is available from CK Witco of Greenwich, Conn. under the trade name SILWET L-7604; and

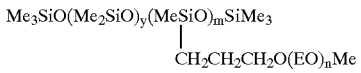

which is available from CK Witco of Greenwich, Connecticut under the trade name SILWET L-7607, wherein Me, EO, y, m, and n are as defined above. The polysiloxane surfactant is preferably present in the composition in an amount ranging from about 0.25 to about 2.0 parts by weight of the total weight of the formulation.

The balance of the coating composition is water, preferably deionized water. Accordingly, the coating composition may contain from about 0 to about 40 parts by weight water, most preferably from about 15 to about 30 parts by weight water.

Preferred ranges for the components of a coating formulation for use with an ink jet printer is contained in the following Table 2:

TABLE 2

| Component | Amount (wt. %) |
|---|---|
| SUPERFLOC E-4217 (cationic amine polymer from Cytec Industries, Inc.) | 1.0–15.0 |
| Calcium chloride dihydrate | 0.24–7.4 |
| Deionized water | 17.4–72.5 |
| Glycerol | 0.0–5.0 |
| 1,2 propanediol | 26.2–42.9 |
| dipropylene glycol | 14.3–26.3 |
| SILWET L-7607 | 0.0–1.0 |
| NALCO 8337[1] | 0.0–2.0 |
| BES free acid buffering agent[2] | 0.01–0.2 |

[1]NALCO 8337 is a corrosion inhibitor available from Nalco Chemical Company, Inc. of Naperville, Illinois.
[2]BES free acid buffering agent is N,N-bis(2-hydroxyethyl)-2-aminoethanesulfonic acid.

In the foregoing formulation, glycerol is added as a relatively high molecular weight humectant to inhibit evaporation of solvent from the formulation so as to enhance the storage stability of the formulation. Other relatively high molecular weight humectants may be used in place of or in addition to glycerol. In the alternative, additional 1,2-propanediol may be used to inhibit solvent evaporation. A corrosion inhibitor and buffering agent are also preferably included in the formulation.

The coating composition may be applied to a web by a variety of methods including spraying, roll coating and the like. It is particularly preferred to apply the coating composition to the web immediately prior to printing so that the web is wet with the coating composition. Accordingly, application of the coating composition to a sheet or web immediately prior to printing using a forward roll coater is particularly preferred. The coating composition may also be applied to the web by thermal jet ejectors similar to the ejectors used for ink. The amount of coating composition applied to the web preferably ranges from about 0.02 milligrams per square centimeter ($mg/cm^2$) to about 0.25 $mg/cm^2$, and most preferably in the range of from about 0.08 $mg/cm^2$ to about 0.14 $mg/cm^2$.

Typically ink is applied to a web in an amount ranging from about 1 to about 2 $mg/cm^2$. Accordingly, it is preferred that the ratio of ink to coating composition on the web range from about 4:1 to about 100:1 parts by weight ink to part by weight coating composition. It is also preferred that the coating composition be applied in close proximity to the printhead of the ink jet printer so that the web remains relatively damp for acceptance of ink ejected from the ink jet printhead. The term "relatively damp" means that the web surface contains sufficient coating composition to enhance the penetration rate of the ink carrier into the web.

As set forth above, in order for the coating formulation to enhance printing on a web, it is important that the coating composition be uniformly applied to the web immediately prior to printing. The coating composition may be applied to the web using any of the coating devices described above. However, it is relatively expensive and time consuming to print test patterns on a web coated with the coating composition in order to determine if the coating system is performing correctly.

An advantage of the invention is that it significantly reduces the need to print test patterns on a web with visible inks in order to determine if the coating system is operating properly during the manufacture of an ink jet printer. According to the invention, a test fluid is provided which is used to coat a paper web using the coating system. Once the coating system passes a coating test as described below, the coating system is drained of the test fluid and assembled into an ink jet printer.

An important feature of the invention is a test fluid which is substantially compatible with the coating composition. Because the test fluid is selected to be compatible with the coating composition described above, it is not necessary to completely remove all of the test fluid from the coating system prior to filling the coating system with the coating composition. Because a portion of the test fluid may remain in the coating system for prolonged periods of time, it is also important that the test fluid be substantially non-corrosive and relatively stable. Evaporation of volatile components from the test fluid may increase the viscosity of the fluid to the point that the fluid causes critical components in the coating system to bond together. Accordingly, it is also preferred that the test fluid have lubricity properties with respect to the coating system so that upon evaporation of volatile components from the fluid, the remaining components inhibit bonding between critical moving parts of the coating system.

A preferred test fluid includes water, a polyol, a surfactant, a radiant energy activated tracer compound and an organic solvent selected from the group consisting of an alkylene glycol and a dialkylene glycol. A particularly preferred polyol is glycerol. The preferred alkylene glycol and dialkylene glycol are described above with respect to the coating composition. The preferred surfactant is a polysiloxane surfactant as described above with respect to the coating composition.

The test fluid preferably contains from about 60 to about 80 percent by weight organic solvent which may be 0 to about 70 percent by weight alkylene glycol or dialkylene glycol or from about 0 to about 70 percent by weight glycerol or a mixture of glycerol and alkylene glycol or dialkylene glycol. The test fluid also contains from about 0.5 to about 2 percent by weight surfactant, from about 0 to about 0.2 percent by weight corrosion inhibitor and from about 0.01 to about 0.2 percent by weight buffering agent. The balance of the test fluid is preferably deionized water which may range from about 10 to about 40 percent by weight of the total weight of the test fluid. Sufficient solvent is preferably provided in the test fluid so as to maintain acceptable solubility of the radiant energy activated tracer compound in the fluid over time thereby minimizing precipitation of the tracer compound in the test fluid.

In order to provide long term storage of the coating system without having to completely remove the test fluid, it is preferred that the test fluid be substantially non-corrosive and have lubricating properties. Unlike the coating composition described above, the test fluid is preferably devoid of the flocculating agent and precipitation agent contained in the coating composition. However, it is preferred that the test fluid contain a corrosion inhibitor and a buffering agent as described above with respect to the coating composition.

An important component of the test fluid not contained in the coating composition described above is a radiant energy activated tracer compound. By "radiant energy" is meant any light source sufficient to activate the tracer and make it readily visible. A preferred radiant energy source is ultraviolet (UV) light.

Other tracer compounds may be used provided they are activatable to visibly indicate distribution of the test fluid on a web. For example, fluorescing colorants that are sufficiently water or glycol soluble may be used in the test fluid. A particularly preferred radiant energy activated tracer compound is a UV fluorescent dye because of its relatively low cost and substantially non-toxic properties. A particularly preferred UV fluorescent dye is available from Ciba Specialty Chemicals of Tarrytown, N.Y. under the trade name TINOPAL SFP.

A preferred radiant energy source used to illuminate the test fluid coated webs and the coating system is a 6 watt 365 nm handheld ultraviolet lamp available from UVP, Inc. of Upland, Calif. model number UVL-56. It is preferred to use sufficient radiant energy sources to illuminate the entire surface of a coated sheet of paper substantially simultaneously during the test procedure described below.

The following Table 3 contains a particularly preferred test fluid formulation.

TABLE 3

| Component | Amount (wt. %) |
|---|---|
| Deionized water | 16.0 |
| 1,2 propanediol | 32.7 |
| Glycerol | 50.0 |
| SILWET L-7607 | 1.0 |

TABLE 3-continued

| Component | Amount (wt. %) |
|---|---|
| NALCO 8337 | 0.02 |
| BES free acid buffering agent | 0.05 |
| TINOPAL SFP dye | 0.2 |

Compared to the coating composition described above, the test fluid has substantially the same physical properties. For example, the pH, viscosity, surface tension and density of the test fluid are similar to the same properties of the coating composition making it highly compatible with the coating composition and providing coating performance characteristics similar to the coating composition. A comparison of the properties of the coating composition and test fluid formulation of Table 3 are given in the following Table 4.

TABLE 4

| Physical Property | Coating fluid Properties Range | Test Fluid Properties |
|---|---|---|
| pH at 25° C. | 6.0–7.0 | 5.9 |
| Viscosity (centistokes) | 35–45 | 40 |
| Surface Tension (dynes/cm) | 30–34 | 30 |
| Density (grams/mL) | 1.05–1.15 | 1.15 |

Selection of an appropriate amount of radiant energy tracer compound in the test fluid is also an important consideration. A high concentration of tracer compound in the test fluid causes the test paper coated with the test fluid to glow more brightly. However, higher concentrations of some radiant energy compounds are less stable in the test fluid solvent system and may precipitate over time or if a small amount of coating composition is mixed with the test fluid. Too low a concentration of radiant energy tracer compound in the test fluid requires a higher-powered radiant energy source or a shorter-wavelength radiant energy source to activate the tracer compound so that it produces a visible indication of the uniformity of the test fluid coating. The uniformity indicated by the tracer compound includes coverage uniformity, thickness uniformity or both coverage and thickness uniformity.

A preferred coating system 10 for an ink jet printer is illustrated in FIG. 1. The coating system 10 is a three roller coating system. The system 10 includes a grit roller 12 which is mounted on a drive shaft 14 in a coating composition trough 16 so that the grit roller 12 is partially submerged in the coating composition 18. The grit roller 12 is preferably a roughened metal roller, but may be a polymeric or elastomeric roller. A motor and gear train (not shown) is connected to the grit roller drive shaft 14 to rotate the grit roller 12 in the trough 16. As the grit roller 12 rotates in the direction of the arrow 20 as shown, the roller 12 picks up coating fluid on its surface 22.

A doctor blade 24 is mounted in the system 10 such that it is in contact with the surface 22 of the grit roller 12 and is disposed at a controlled angle and force. The doctor blade 24 meters the coating composition 18 on the surface 22 of the grit roller 12 , enabling a controlled portion of the coating composition to remain on the grit roller 12 past the blade 24. The doctor blade 24 is preferably a resilient, elastomeric, wear-resistant material such as, but not limited to, polyurethane. The thickness, width, material properties, and mounting geometry of the doctor blade 24 are preferably selected so that the interference between the blade 24 and the surface 22 of the grit roller 12 causes the blade 24 to deflect. This deflection results in the controlled contact angle and force necessary to properly meter the coating composition onto the grit roller surface 22.

The grit roller 12 is preferably in spring-loaded contact with an applicator roller 26 mounted on a shaft 28. The applicator roller 26 may be externally driven or driven by frictional contact with the grit roller 12. The applicator roller 26 is preferably an elastomeric roller, such as a cast polyurethane material, but other materials, such as polymeric or metallic materials may be used for the applicator roller 26. A controlled portion of the coating composition 18 that passes the doctor blade 24 is transferred to the applicator roller 26. A third roller, backup roller 30 mounted on a shaft 32, is in spring-loaded contact with the applicator roller 26 and may be externally driven or driven by frictional contact with the applicator roller 26.

A web, preferably a cellulosic web 34 to be coated is fed through a nip 36 between the applicator roller 26 and back-up roller 30 with the printing side of the web 34 in contact with the surface 38 of the applicator roller 26. During the coating process, the coating composition 18 is transferred from the applicator roll 26 to the surface 40 of the web 34 thus coating the web 34.

Seals 42 and 44 along the length of the applicator roller 26 and seals (not shown) at each end of the applicator roller 26 prevent leakage of the coating composition 18 out of the coating system 10 and prevent external contaminants from entering the coating system 10. The seals 42 and 44 also significantly reduce the evaporation rate of the coating composition in the trough 16. Seals (not shown) are also provided where each roller shaft 14, 28 and 32 passes through the end of the coating system 10. These seals also prevent leakage, seal out contaminants, and reduce evaporation of the coating composition 18. The rollers, seals and trough are enclosed in a housing 46. The housing 46 is sealed as described above and contains means for sensing the level of coating composition 18 in the trough and means for replenishing the coating composition 18 as required.

Prior to filling the trough with the coating composition, the test fluid is inserted in the coating system 10 described above. The test fluid enables each coating system 10 incorporated in an ink jet printer to be assembled and functionally tested in order to adjust the coating weights applied by the system 10 to webs 34. The functional test also identifies any defects or leaks in the system 10 so that repairs to the coating system 10 may be made before the coating system 10 is installed in a printer. According to the test procedure, the test fluid is inserted into the trough 16 of the coating system 10 and blank sheets of paper are coated with the coating system using a test stand to operate the coating system 10. After coating blank sheets of paper with the test fluid, the sheets are examined under an ultraviolet light. For the purposes of the method of the invention, it is important to use blank sheets of paper which do not contain compositions or coatings which significantly interfere with the function of the tracer compound to indicate coating uniformity. A suitable blank paper sheet for testing the coating system 10 with the test fluid is a paper product available from Willamette Industries, Inc. of Portland, Oreg. under the trade name of WILLCOPY XEROGRAPHIC DP.

The presence of the UV fluorescent dye in the test fluid causes the coated sheets to glow so that variation in coat weight across the sheets is easily detected. A failure of the coating system 10 to uniformly coat the sheet is evidenced by absence of the activated or glowing tracer compound when the sheet is exposed to the radiant energy source. It will also be recognized that non-uniform coating weights of the test fluid applied to the sheets may provide different glow intensities when the sheet is exposed to the radiant energy source. The test stand may also be configured to measure the torque required to operate the coating system 10 thereby identifying incorrect assembly of the coating system 10 or out of tolerance parts.

After the uniformity of the coating is determined, and any necessary adjustments made to the coating system 10, a hand held radiant energy source may be used to inspect the critical areas, including the seals of the coating system for leaks. The radiant energy source causes the test fluid to glow on the coating system components where leaks of the test fluid have occurred.

Figure 2:
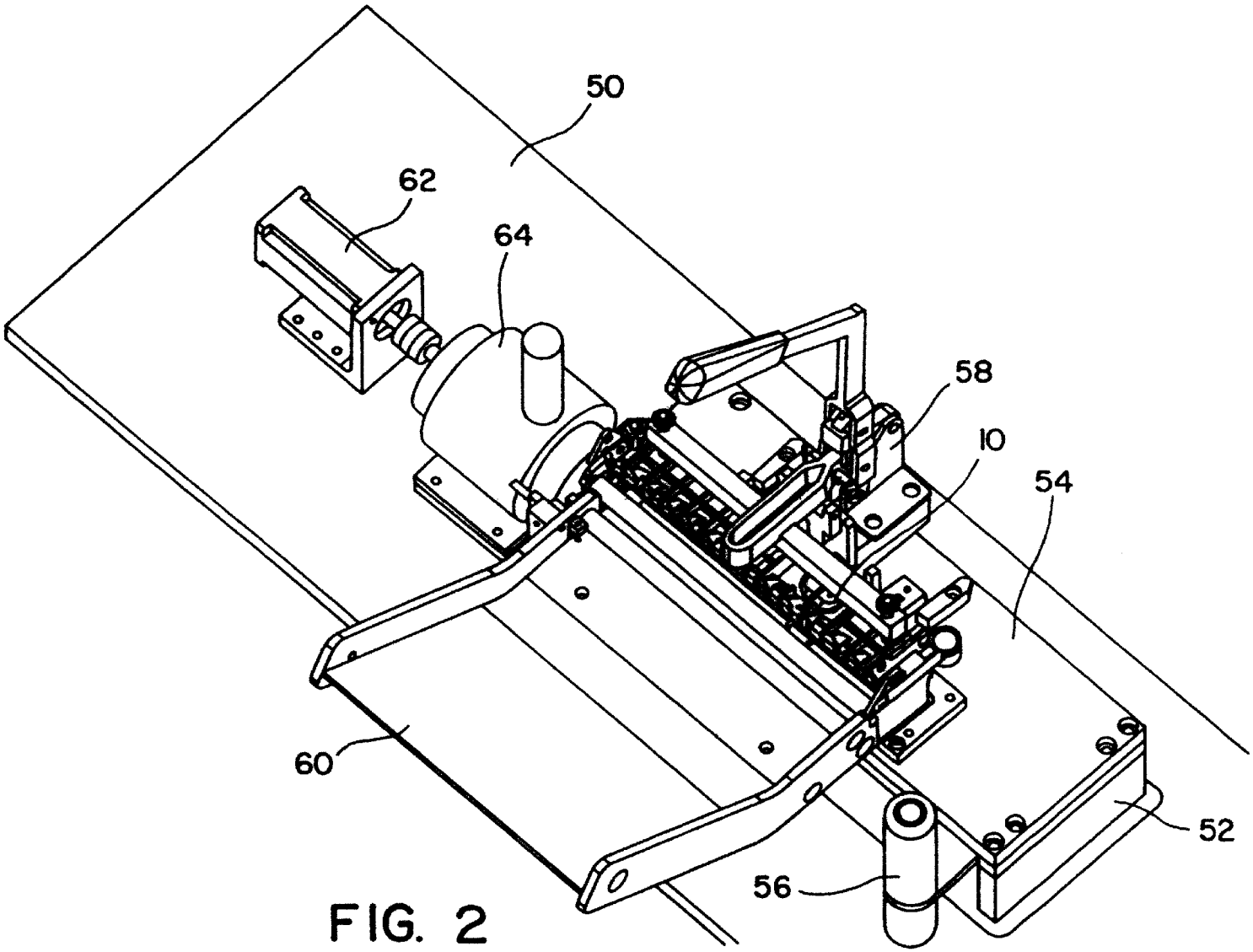
FIG. 2 is a perspective view of a test stand for operating a coating system with a test fluid according to the invention.

A test stand 50 for operating the coating system 10 with the test fluid is illustrated in FIG. 2. The test stand 50 includes a clamping support mechanism 52 including a support table 54 and clamps 56 and 58 for holding the coating system 10 substantially immovable during a performance test thereof with the test fluid. A paper feed tray 60 is provided to hold a sheet of paper 34 for feed to the coating system 10 during the test. A variable speed motor 62 is coupled to a torque measurement device 64 which is in turn connected to a gear drive train (not shown) on the coating system 10. After a sheet of paper 34 is coated with the test fluid, the sheet of paper is exposed to a radiant energy source to activate the tracer compound in the test fluid coating causing the coating on the sheet 34 to glow as described above. The torque measurement device 64 provides an indication of proper or improper alignment of the rollers in the coating system 10. Conventional control and logic circuitry is also provided for the test stand 50 to provide performance data and to control the test sequence.

As set forth above, the foregoing description of a test fluid and method for testing a web coating system is directed specifically to use of a radiant energy activated tracer compound. It will be recognized, however, that other tracer compounds, including visible tracer compounds which don't require the use of a radiant energy source may be used to test the coating system 10 in accordance with the invention.

It is contemplated, and will be apparent to those skilled in the art from the foregoing specification that modifications and/or changes may be made in the embodiments of the invention. Accordingly it is expressly intended that the foregoing are only illustrative of the preferred embodiments and is not limiting thereto and that the true spirit and scope of the present invention be determined by reference to the appended claims.

What is claimed is:

1. A test fluid for detecting coating flaws in a coated web, the test fluid comprising from about 10 to about 40 percent by weight water based on the total weight of the test fluid, a polyol, a surfactant, from about 0.05 to about 0.5 weight percent radiant energy activated tracer compound based on the total weight of the test fluid, and an organic solvent selected from the group consisting of an alkylene glycol, a dialkylene glycol, and tripropylene glycol.

2. The test fluid of claim 1 wherein the surfactant comprises a polysiloxane surfactant.

3. The test fluid of claim 2 wherein the polysiloxane surfactant is a compound having the following general structure:

$$Me_3SiO(Me_2SiO)_y(\underset{\underset{PE}{|}}{MeSiO})_mSiMe_3$$

wherein: PE comprises $—CH_2CH_2CH_2O(EO)_n(PO)_oZ$, Me is a methyl group, EO is an ethyleneoxy group, PO is 1,2-propyleneoxy group, Z is H or a methyl group, y is an integer ranging from about 1 to about 10, m is an integer ranging from about 1 to about 10, n is an integer ranging from about 0 to about 5, and o is an integer ranging from about 0 to about 5.

4. The test fluid of claim 1 wherein the organic solvent is selected from the group consisting of tripropylene glycol, dipropylene glycol, 1,2-propanediol and mixtures of dipropylene glycol and 1 ,2-propanediol having a surface tension ranging from about 25 to about 45 dynes/cm.

5. The test fluid of claim 1 wherein the radiant energy activated tracer compound comprises an ultraviolet (UV) fluorescent dye.

6. The test fluid of claim 1 further comprising from about 0 to about 0.2 percent by weight corrosion inhibitor.

7. The test fluid of claim 1 further comprising from about 0.01 to about 0.2 percent by weight buffering agent.

8. The test fluid of claim 7 wherein the buffering agent comprises N,N-bis(2-hydroxyethyl)-2-aminoethanesulfonic acid.

9. The test fluid of claim 1 comprising, deionized water, propylene glycol, glycerol, a surfactant, a buffering agent and from about 0.05 to about 0.5 percent by weight UV fluorescent dye.

* * * * *